US008579292B2

(12) United States Patent
Salerno

(10) Patent No.: US 8,579,292 B2
(45) Date of Patent: Nov. 12, 2013

(54) THREE-CARD DRAW POKER GAME

(76) Inventor: Peter Salerno, Lemont, IL (US)

( * ) Notice: Subject to any disclaimer, the term of this patent is extended or adjusted under 35 U.S.C. 154(b) by 94 days.

(21) Appl. No.: 12/464,672

(22) Filed: May 12, 2009

(65) Prior Publication Data

US 2009/0289417 A1 Nov. 26, 2009

Related U.S. Application Data

(60) Provisional application No. 61/105,972, filed on Oct. 16, 2008, provisional application No. 61/055,301, filed on May 22, 2008.

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS

| | | | | |
|---|---|---|---|---|
| 6,523,831 | B2 * | 2/2003 | Webb | 273/292 |
| 6,592,125 | B1 * | 7/2003 | Lizak | 273/292 |
| 6,626,433 | B2 * | 9/2003 | Scibetta | 273/292 |
| 6,629,889 | B2 * | 10/2003 | Mothwurf | 463/25 |
| 7,137,883 | B1 * | 11/2006 | Falciglia, Sr. | 463/13 |
| 7,172,198 | B2 | 2/2007 | Parham | |
| 7,188,838 | B2 | 3/2007 | Jones et al. | |
| 7,246,799 | B2 | 7/2007 | Snow | |
| 7,264,243 | B2 | 9/2007 | Yoseloff et al. | |
| 7,270,330 | B2 | 9/2007 | Falciglia, Sr. | |
| 7,331,865 | B2 | 2/2008 | Baerlocher et al. | |
| 7,341,513 | B2 | 3/2008 | Cuddy et al. | |
| 7,429,046 | B2 * | 9/2008 | Aida | 273/292 |
| 7,618,321 | B2 * | 11/2009 | Crawford et al. | 463/29 |
| 7,637,506 | B2 * | 12/2009 | Naicker | 273/292 |
| 7,651,894 | B2 * | 1/2010 | Song | 438/132 |
| 7,699,695 | B2 * | 4/2010 | White et al. | 463/13 |
| 7,722,048 | B2 * | 5/2010 | Smith et al. | 273/292 |
| 7,789,393 | B2 * | 9/2010 | Tucker et al. | 273/272 |
| 7,803,051 | B2 * | 9/2010 | Kuhn et al. | 463/36 |
| 7,824,255 | B2 * | 11/2010 | Lutnick et al. | 463/13 |
| 7,832,730 | B2 * | 11/2010 | Calderon | 273/243 |

OTHER PUBLICATIONS http://www.google.com/?tbm=pts&hl=en.*
"Draw Poker," downloaded from the Internet at http://en.wikipedia.org/wiki/Draw_poker on Feb. 26, 2008; 7 pp.
"Lowball (poker)," downloaded from the Internet at http://en.wikipedia.org/wiki/Lowball_%28poker%29 on Feb. 26, 2008, 5 pp.
"Three Card Poker How to Play," downloaded from the Internet at http://www.eamobile.com/Web/CA/en/mobile-games/ProductHowToView/product-24522 on Aug. 10, 2009, 4 pp.
"How to Play Three-Card Poker," downloaded from the Internet at http://cgtv.com/games/features/three_card_poker.shtml on Aug. 10, 2009, 4 pp.

* cited by examiner

*Primary Examiner* — Kurt Fernstrom
*Assistant Examiner* — Dolores Collins
(74) *Attorney, Agent, or Firm* — W. Dennis Drehkoff; Kelly & Krause, L.P.

(57) ABSTRACT

A method of playing a three-card draw poker game utilizing at least one deck of cards, wherein one card is a face down hold card for the players wherein low score wins. The game is played against the house with or without a hand. When playing without the house having a hand, the players' hand must beat a hypothetical score set by the house. A bonus bet can be made prior to dealing for increased payout for having a predetermined score, called a bonus pat hand, upon receiving dealt cards additional bonus bets can be made. An electronic system for performing the method is also described.

10 Claims, 9 Drawing Sheets

THREE-CARD DRAW POKER GAME

CROSS-REFERENCE TO RELATED APPLICATIONS

The present patent application claims priority from and the benefit of U.S. Provisional Patent Application No. 61/105,972, filed Oct. 16, 2008, and entitled Three-Card Draw Poker Game, and U.S. Provisional Patent Application No. 61/055,301, filed May 22, 2008, and entitled Three-Card Draw Poker Game, which prior applications are hereby incorporated herein by reference.

FIELD OF THE INVENTION

The present invention relates to a poker card game. More specifically, the present invention is directed to a method of playing a three-card draw poker game wherein each player plays against the dealer representing the house or against a hypothetical hand with the lowest score being the winning hand.

DESCRIPTION OF THE PRIOR ART

While there are numerous types of poker games, two types are extremely popular: draw poker, in which all of player's cards are unknown to his opponents, and stud poker, in which some of the players cards are face up and others face down. Included in the two above categories there are other games, including, for example, Hold 'Em or Texas Hold 'Em. The games are so popular that they are shown on television wherein a minicamera is utilized to view each player's hand so that the viewer has the benefit of watching the entire game from each player's perspective and collectively all of the players' hands. In Hold 'Em, each player makes a sufficient ante bet and is dealt two cards face down. After a betting interval, three communal cards are dealt face up. Second bets are then placed and the dealer turns up one more communal card. Betting takes place again. The dealer then turns up the final communal card, a final round of betting takes place, and the player with the highest ranking poker hand selected from among his own cards and the five communal cards wins.

Many patents have been granted covering various types of poker.

U.S. Pat. Nos. 4,836,553 and 4,948,134 disclose a poker game played in a casino against a dealer. If the player wins, he receives the bonus payment depending upon the rank of his hand. Sklinsky U.S. Pat. No. 5,382,025 describes a variation of Texas Hold 'Em. Players do not compete against one another. Cards are dealt face up and the players select a two-card hand. U.S. Pat. No. 5,417,430 describes a poker game in which the players place three bets at the beginning of the game. However, as the game progresses, players are given the option of withdrawing two of the bets.

U.S. Pat. Nos. 4,836,553 and 4,861,041 describe variations in poker games that are collectively referred to as Caribbean Stud. In the '553 patent, each player places a primary bet ("ante"). The dealer for the house deals five cards to each player and to himself face down except for one card in the dealer's hand. After viewing his card, each player may fold or make an additional bet. Thereafter, the dealer reveals his hand. If the dealer's hand is at least Ace-King, the winner compares his hand to each of the players. Bets are paid or collected by the dealer with scoring based on traditional high-card poker.

U.S. Pat. No. 5,901,858 describes a poker game using one or more decks of 20 cards each, namely, the tens and face cards of each suit. Unlike Caribbean Stud described above, only three cards are dealt face down to each player and only two to the dealer. One of the dealer's cards is shown as a face-up community card, which may be utilized by each player as a fourth card of the players' five-card poker hand. After reviewing the three cards and the community card, each player has the option of either staying with his initial bet or placing an additional bet. The three cards are then turned face up. The dealer then turns up the second of the dealer's two cards as a second community card. The five-card poker hands of all players are evaluated and payouts are made according to a payout table.

U.S. Pat. No. 6,132,311, issued to Williams, discloses a game wherein a player makes one wager to play two or more, and preferably five, hands of five cards each against a pay table, and the player attempts to make the highest ranking five-card poker hand in each hand. Using a standard deck of fifty-two playing cards, two cards are dealt face up and are the community cards that are common to each hand. The remaining three cards for each hand are dealt face down. The player may discard none, one, or both of the face-up community cards and receives replacement cards for the discarded cards, if any. The player may double his wager before or after the draw step. When the draw step is completed and the player has doubled his wager or not, the player presses the deal button and the remaining three face-down cards are revealed. The community cards are used with each of the partial three-card hands to form final five-card hands. The player wins on any five-card hand that has a preestablished poker hand ranking as shown in the pay table. In one variation, a sixty-five card deck is used, which has five thirteen-card suits.

A patent application by Schlumbrecht (U.S. Patent Publication No. 2004/0036217 A1) discloses a flop poker game being played with each player making an ante bet and a pot bet at the start of the game. Each player is dealt three cards face down and the dealer deals three cards to a designated area on the table face down. Each player plays his hand and determines to stay in the hand by making the flop bet to see the flop cards or by folding the hand and surrendering the ante bet to the house and the pot bet to the player's pot. The players who remain in the game see the flop. All cards are revealed at the same time. They use three cards from their hand and any two cards from the flop. No additional wagering is necessary to use the sixth card to make the best five-card poker hand. The game concludes with the dealer revealing all players' hands to search for the highest poker hands on the table. This game uses a standard fifty-two card deck.

A patent application by Jones et al. (U.S. Patent Publication No. 2003/0155713 A1) discloses a method of playing card games wherein a dealer deals seven cards to each player with all the cards dealt face down. The players view their cards and each player has the option to either fold and lose an ante wager or call by making a bet wager exactly twice their ante wager.

The foregoing poker games emphasize a high hand or high score for winning. Some forms of poker, often called Low Ball or Low Poker, reward poor poker hands. Typically, three variations of this concept differ as to whether aces are treated as high cards or low cards and whether straights and flushes are used. Briefly, the methods are as follows:

In Ace-to-Five, the lowest possible hand is 5-4-3-2-A, called a wheel, and straights and flushes are ignored.

In Ace-to-Six Low, also called 6-4 Low, the lowest possible hand is 6-4-3-2-A. Aces are low and straights and flushes count as high hands.

In Deuce-to-Seven Low, also called 7-5 Low, the lowest possible hand is 7-5-4-3-2. This is inversely proportional to the traditional poker "high hand." Aces are high and straights and flushes count as high hands. Since aces are high, A-5-4-3-2 is not a straight but is instead an ace-high no pair.

In Deuce-to-Six Low, aces are high and straights and flushes are ignored.

A typical Ace-to-Five Low game is California Lowball, which is draw poker with traditional betting and one joker in the deck. Ace-to-Five Low is a common method for evaluating low hands in poker and is used in most casinos in the United States.

As in conventional low hand games, pairs count against the player. That is, any hand with no pair defeats any hand with a pair, one pair hands defeat two pair or three of a kind, etc. No-pair hands are compared starting with the highest ranking card, just as in high poker, except that the high hand loses. In Ace-to-Five Low, straights and flushes are ignored, and aces play as the lowest card.

For example, the hand 8-5-4-3-2 defeats 9-7-6-4-3, because eight-high is lower nine-high. The hand 7-6-5-4-3 defeats both, because seven-high is lower still, even though it would be a straight if played for high. Aces are low, so 8-5-4-3-A defeats 8-5-4-3-2. Also A-A-9-5-3 (a pair of aces) defeats 2-2-5-4-3 (a pair of deuces), but both of those would lose to an pair hand such as K-J-8-6-4.In the rare event that hands with pairs tie, kickers are used just as in high poker (but reversed): 3-3-6-4-2 defeats 3-3-6-5-A. This is called Ace-to-Five Low because the lowest (and therefore best) possible hand is 5-4-3-2-A, called a wheel. The next best possible hand is 6-4-3-2-A, followed by 6-5-3-2-A, 6-5-4-2-A, 6-5-4-3-A, 6-5-4-3-2, 7-4-3-2-A, 7-5-3-2-A, etc.

Low hands are referred to by their highest ranking card or cards. Any nine-high hand can be called a "nine," and is defeated by any "eight." Two cards are frequently used: the hand 8-6-5-4-2 can be called an "eight-six" and defeats an "eight-seven" such as 8-7-5-4-A.

Another common notation is calling a particular low hand "smooth" or "rough." A smooth low hand is one where the remaining cards after the highest card are themselves very low; a rough low hand is one where the remaining cards are high. For instance, 8-7-6-3-A would be referred to as a "rough eight," whereas 8-4-3-2-A would be referred to as a "smooth eight."

Kansas City Lowball is a draw poker game played with 2-7 ranking and is typically played with no-limit betting. This game is opposite of standard poker, for the high hand loses.

As in all lowball games, pairs and triples are undesirable. That is, any hand with no pair defeats any hand with a pair, one pair hands defeat two pair or trips, etc. No-pair hands are compared starting with the highest ranking card, just as in high poker, except that the high hand loses. In Deuce-to-Seven Low, straights and flushes count for high and are therefore undesirable. Aces are always high and are therefore undesirable.

For example, in Deuce-to-Seven Low, as in Ace-to-Five Low, the hand 8-5-4-3-2 defeats 9-7-6-4-3, because eight-high is lower than nine-high. The hand 7-6-5-4-2 defeats both, because seven-high is lower still. The hand 7-6-5-4-3 would lose, because it is a straight. Aces are high, so Q-8-5-4-3 defeats A-8-5-4-3.In the rare event that hands with pairs tie, kickers are used just as in high poker (but reversed): 3-3-6-4-2 defeats 3-3-6-5-2.Since the ace always plays high, A-5-4-3-2 is not considered a straight. It is simply ace-high no pair and would therefore lose to any king-high but would defeat A-6-4-3-2.

The best possible hand is 7-5-4-3-2, hence the name Deuce-to-Seven Low, followed by 7-6-4-3-2, 7-6-5-3-2, 7-6-5-4-2, 8-5-4-3-2, 8-6-4-3-2, etc.

Information about Lowball or Low Poker can be retrieved from http://en.Wikipedia.org/wiki/lowball_%28 poker %29.None of the references above disclose the present invention.

SUMMARY OF THE INVENTION

One aspect of the present invention is to provide simple and fast-paced game play for draw poker.

Another aspect of the present invention is to provide a novel, three-card, low-score poker game enabling a bonus bet for more exciting game play.

Another aspect of the present invention is to provide an ante bet enabling each player to play a poker hand.

Another aspect of the present invention is to provide a mulligan or draw bet with an even payout unless made with bonus pat hand bet for paying an increased payout.

Another aspect of the present invention is to provide an optional press bet if no mulligan bet is made and if a bonus pat hand bet is made.

Another aspect of the present invention is to provide a poker game that may be played wherein the house does not play a hand and the player plays against a hypothetical score.

According to an embodiment, a method of playing a card game with at least one deck of cards comprises the steps of:

(a) providing three cards from the deck of cards face down to each player and dealer;

(b) removing one card from the three cards dealt to each player and placing it as a hold card, leaving each player with two cards;

(c) requiring each player to select and remove zero, one, or two cards from the two cards remaining in step (b);

(d) providing each player the number of cards discarded in step (c) from the deck;

(e) displaying the dealer's cards;

(f) displaying the hold card; and (g) determining the score of each player's hand compared to the dealer's hand.

An optional bonus bet may be made by each player prior to dealing any cards. The bonus bet is for a low-score pat hand, e.g., a score of 7 or less. This hand is named a bonus pat hand to distinguish it from other hands utilized by players. The score is arbitrary and is set by the house and has a higher payout than any other type of bet in the game. The player believes the bonus pat hand will defeat the dealer's hand. The player does not take further action after making the bonus bet and securing cards but must wait for the round of play to finish to determine if his bonus pat hand beats the dealer's hand. The bonus pat hand requires one of five designated combinations of cards for the high payout.

A second or ante bet is made by a player who wishes to play against the dealer to determine the lowest score of cards dealt to the player. The ante bet is also made before any cards are dealt. It can be made separately or with a bonus bet. It has an even payout. In the instance where a bonus bet is made and an ante bet is made indicating the player wishes to play a hand of low-card poker, the bonus bet would be paid only for certain combinations of cards, notwithstanding whether the player has the lowest score against the dealer. If the player wins on both bets by having a designated bonus pat hand and ante bet with the low score, all bets are paid. If the player has only a low score, the ante bet is paid.

A third or draw bet is made by the player after receiving his cards but before discarding unwanted cards and receiving new cards from the dealer. This bet is known as a mulligan bet.

It has an even payout and the amount bet can be no higher than the amount of the ante bet. This provides another opportunity for the player to beat the dealer.

A fourth bet is a press bet, which is made if no mulligan bet is made and no additional cards are drawn. The press bet has the same payout as a mulligan bet, both of which are lower than the payout for a bonus pat hand bet. The arbitrary payouts of betting schemes provide added interest and excitement to the game.

Odds and payouts can be determined by the house for each category of bet. The odds and payouts described herein are arbitrary and not intended to be limitative. They can be modified or determined at will.

According to another embodiment, the card game is played with a dealer wherein the house does not have a hand comprising the steps of:

(a) setting hypothetical score;

(b) providing three cards from the deck of cards face down to each player, the cards typically being dealt by a dealer who does not represent the house;

(c) removing one card from the three cards dealt to each player and placing it as a hold card, leaving each player with two cards;

(d) requiring each player to select and remove zero, one, or two cards from the two cards remaining in step (c);

(e) providing each player the number of cards discarded in step (c) from the deck;

(f) displaying the hold card;

(g) determining the score of each player's hand;

(h) comparing the score of each player's hand to a hypothetical score of the house; and (i) determining if each individual player's hand is lower than the hypothetical score of the house and settle the bets.

In this embodiment, the hypothetical score is determined by the house. Without the dealer playing a hand for the house, the game progresses at a fast pace.

Bonus, ante, mulligan, and press bets are designated as previously described.

According to another embodiment, a system is disclosed for playing the game electronically.

DETAILED DESCRIPTION

Figure 1:
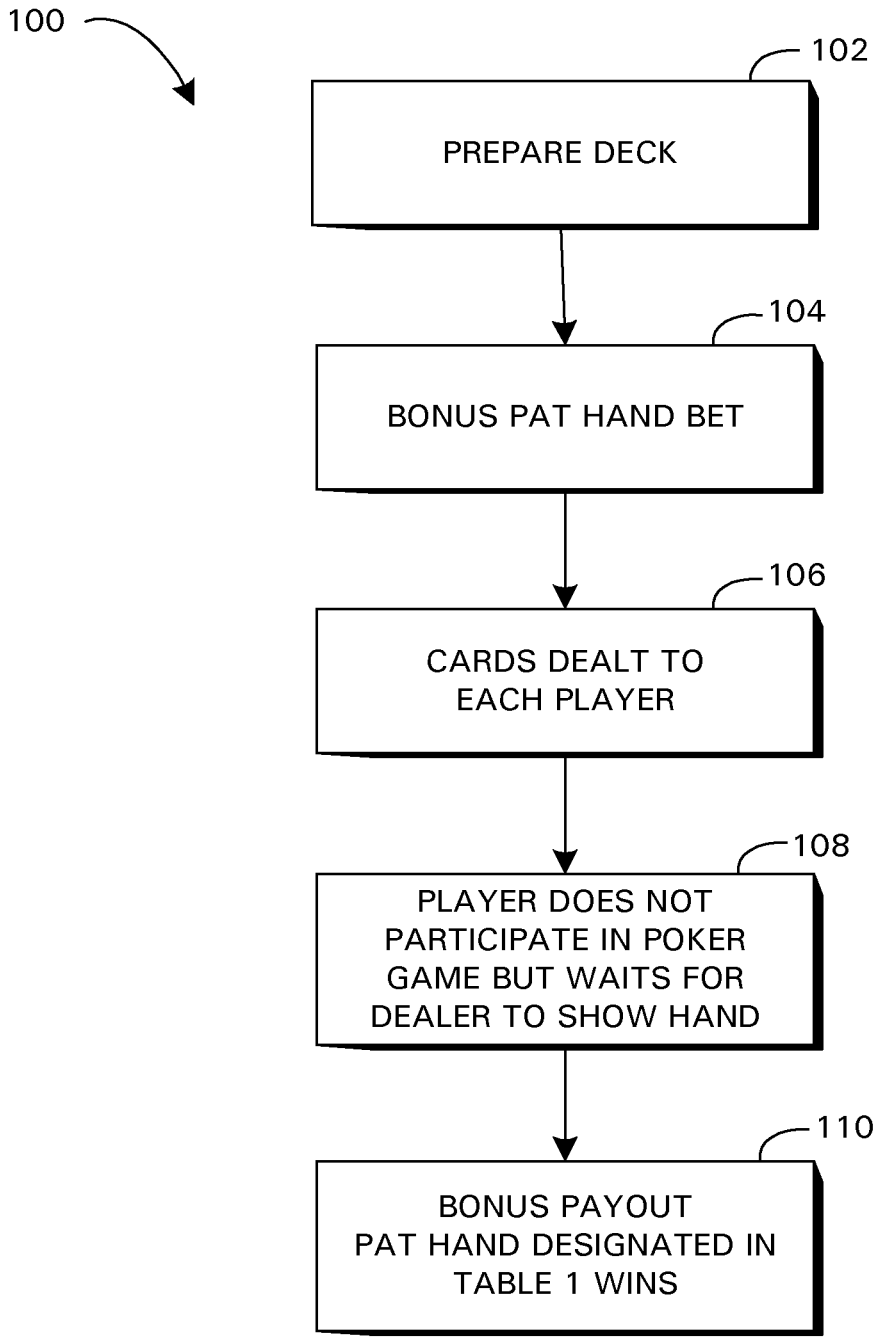
FIG. 1 shows a flow diagram of an embodiment of a method of playing a card game according to the present invention wherein a bonus bet is made in the game.

The present invention provides a method of playing a card game with one or more decks of cards, preferably with at least one deck of cards, that is generally embodied in a three-card draw poker game.

The game can be played with a gaming table, as a board game, or on a computing device. An example of a computing device is a casino-type gaming machine, such as a slot machine, having a touch screen and/or buttons for receiving player inputs and configured for receiving and awarding money. Other computing devices for playing the game are envisioned, such as a PDA, personal computer, cellular telephone, etc.

The game is primarily described in conjunction with figures showing implementations of more than one version of the game according to the present disclosure. It is envisioned that multiple versions of the game can be implemented, such as a set of programmable instructions or some other format for execution by at least one processor embedded in a gaming system.

Generally, a brief description of the game is as follows, wherein in one embodiment, this is a basic player-versus-dealer contest. The dealer and each player are dealt three cards and can draw up to two or more after discarding cards. The player's objective is to have a lower three-card total than the dealer using card values similar to Black Jack (A=1, K=10, Q=10, J=10). The house edge comes from the players being forbidden from seeing his third card until after drawing, while the dealer is permitted to discard and replace any two or three cards after seeing all three. A player draws first without seeing the dealers cards, and the dealer is required to follow a fixed rule in determining which cards to discard and replace. The player wins even money on his "ante bet" if his three-card total is lower than the dealer's. total. The player loses is his total is higher than the dealer's total, and the player pushes if there is a tie. In another embodiment, the player may be required to beat a fixed three-card score rather than the dealer's score. Additionally, the player may make bonus bets based on the value and composition of his original three-card hand ("pat hand bonus bet") and on the value and composition of his final three-card hard after discarding and replacing cards ("mulligan bet" or "press bet"). The term "mulligan" is used when the player draws a card and the "press" when he stands pat. All bets must be placed before any cards are seen, and the player is required to make an ante bet in order to make the bonus bet. This leads to more complicated strategic situations because the discard strategy that is optimal for maximizing the player's return on the bonus bet (which regards extra low hands with large payouts) are different from the optimal strategy for the even-money ante bet (where any score that beats the dealer is equally good).

In greater detail, the game described can be formatted and designed for play by at least one player or an easy one-player or multiplayer game using a set of programmable instructions stored on computer-readable media, such as a magnetic, optical, opto-magnetic, or electronic storage medium, etc., which is capable of being executed by at least one processor for individual play (one player) or multiple play (multiple players) utilizing standalone computing devices, casino machines, game consoles, computers, kiosks, etc., to access the set of programmable instructions stored on the device or electronically access a playable version of the game via the Internet or other local area networks (LANs) or wide area networks (WANs). Handheld computing devices may also be utilized with a hardwired or wireless (PDAs, cell phones, media players, etc.) to access the set of programmable instructions stored on the device or electronically access a set of programmable instructions of the game via the Internet, or other local area networks or other wide area networks. Further, interactive television devices can be utilized, such as set-top boxes, etc., to access the set of programmable instructions over a closed network (cable, satellite, etc.) or broadcast television networks, including live TV game shows.

The game utilizes a golf game motif on the table or by computer so that a player can readily identify with the various representations from the game of golf and therefore knows where to place cards and bets and generally play the game. The three-card, low-score poker game is considered analogous to a par 3, low-scoring golf game. The low scores in golf are analogous to high odds or payouts. For example, in one analogy, a hole-in-one indicating the lowest score possible in a golf game, is similar to a A-A-A hand and therefore is rewarded with the highest odds or payout in the poker game.

Figure 4:
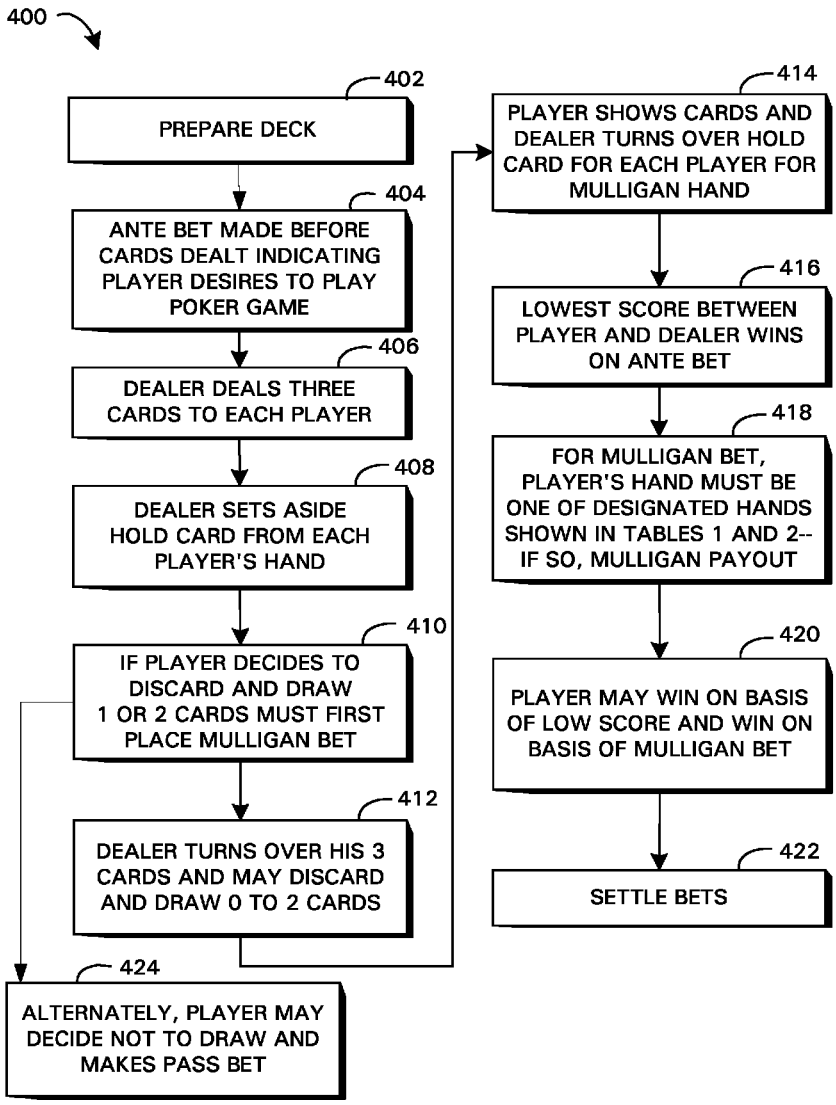
FIG. 4 shows a flow diagram of another embodiment of the method of playing a card game according to the present invention wherein ante and mulligan bets are made in the game.
Figure 5:
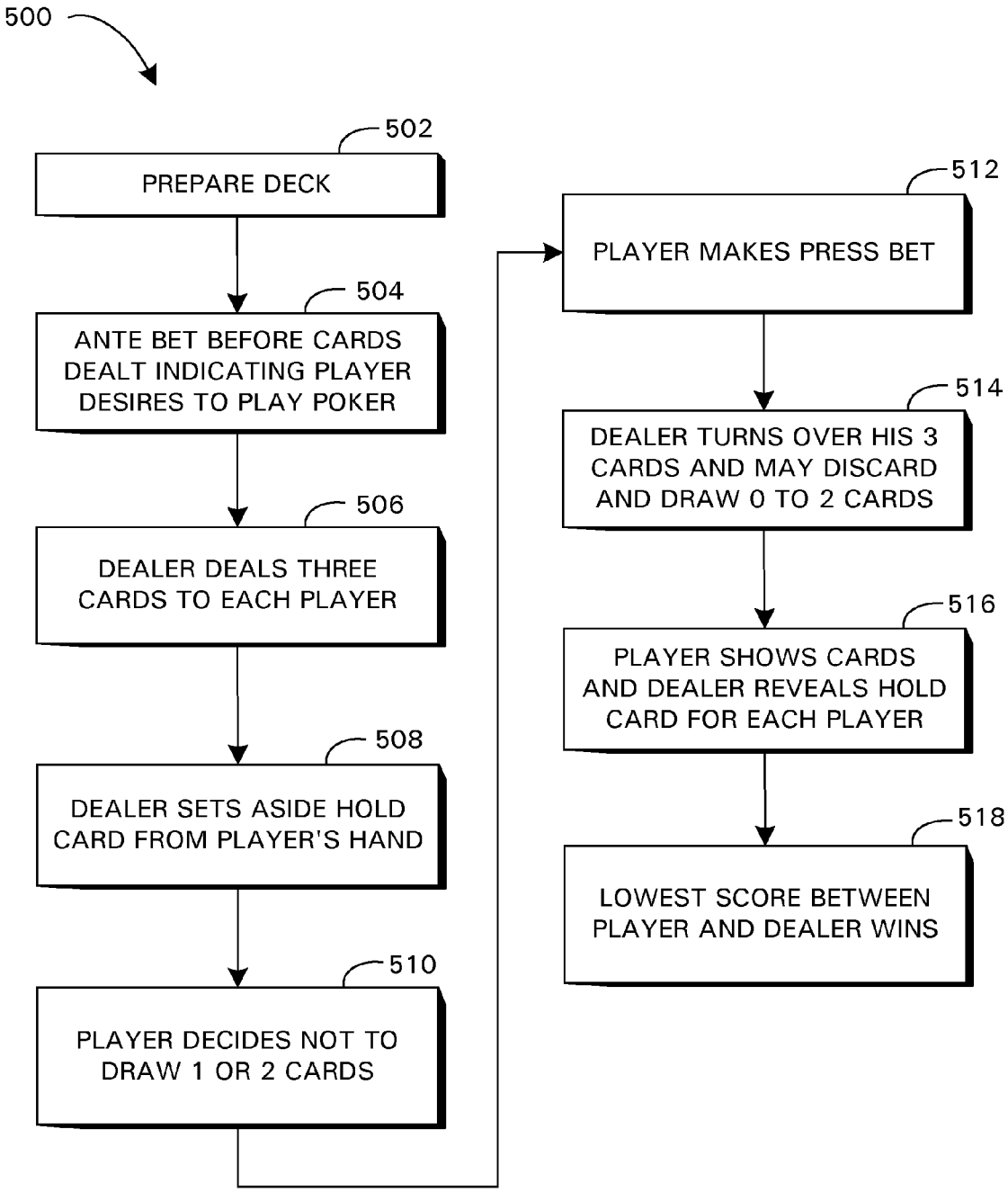
FIG. 5 shows a flow diagram of another embodiment of a method of playing a card game according to the present invention wherein ante and press bets are made in the game.
Figure 6A:
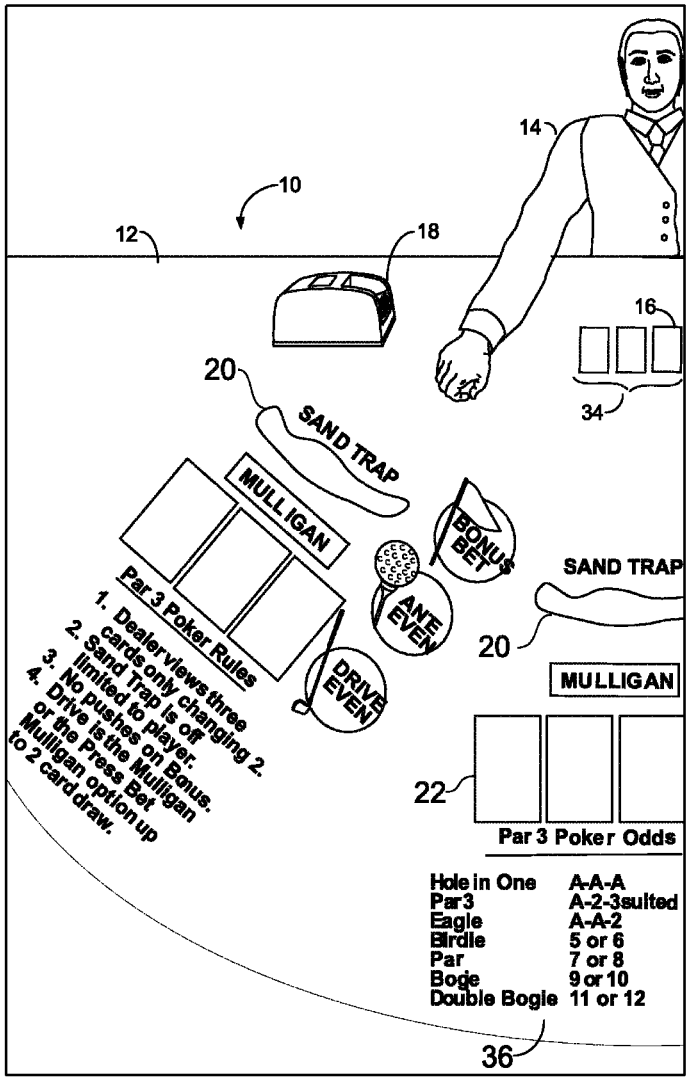
FIG. 6A shows a representation of a left side of a tabletop for a card game with markers used in an embodiment of the method of playing a card game according to the present invention.
Figure 6B:
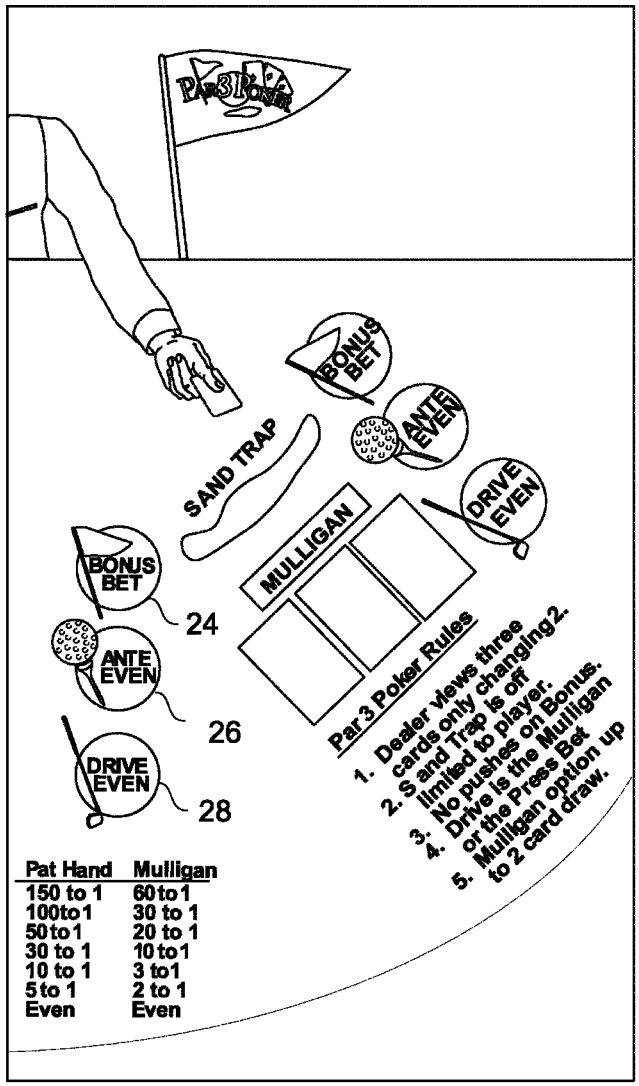
FIG. 6B shows a representation of a right side of a tabletop for a card game with markers used in an embodiment of the method of playing a card game according to the present invention.
Figure 7:
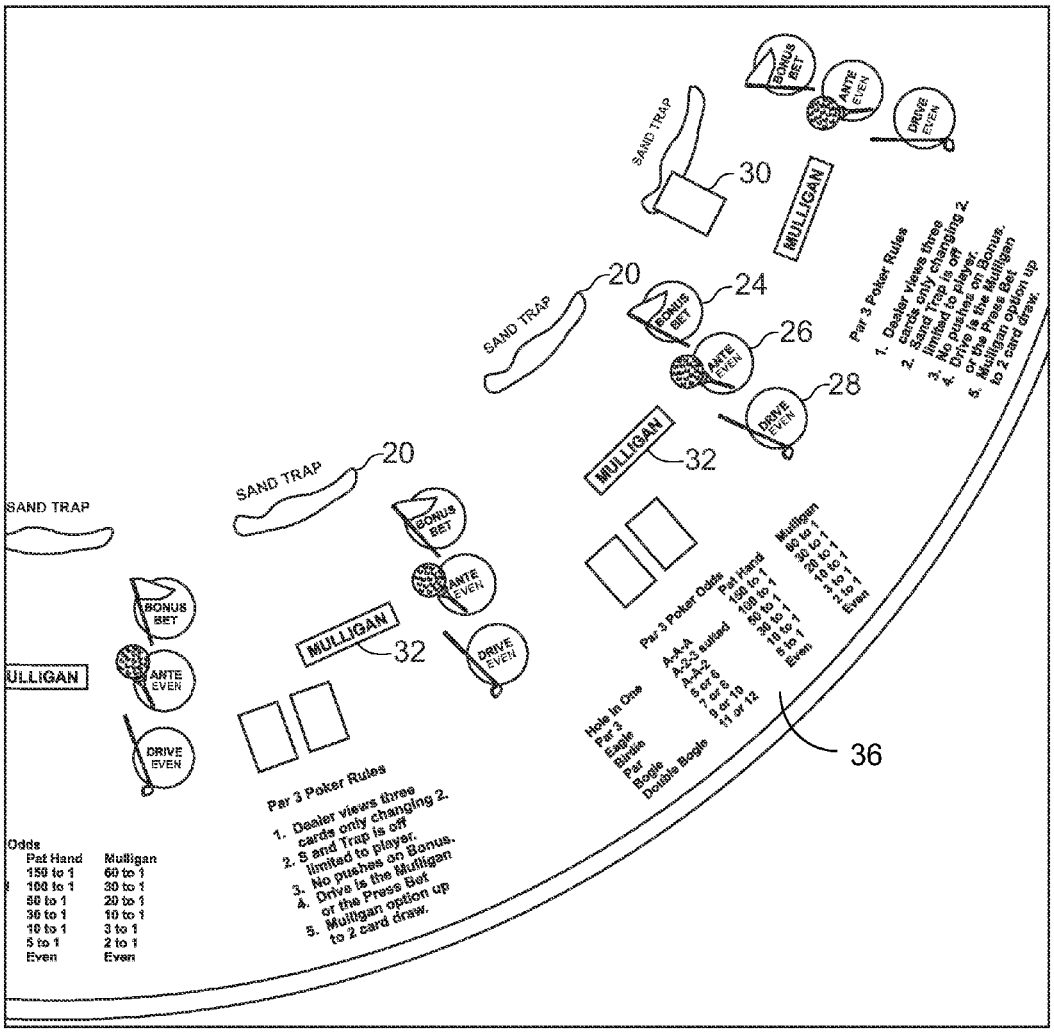
FIG. 7 shows a exploded view of one section of the tabletop showing markers for an embodiment of the method of playing a card game according to the present invention.

Referring to FIGS. 1-8, the present invention is directed to multiple embodiments described in FIGS. 1-5 of a card game 10, which is a variation of a poker game. Unlike most poker games, however, card game 10 is won by having the lowest ranking hand or lowest score. Card game 10 can be played at a table 12 with a dealer 14 dealing the cards 16 to players where the dealer represents the house or, alternatively, when the house does not play a hand and the players play against a hypothetical limit that represents payment to the house. FIGS. 6 and 7 depict a game table. The game as described below is primarily on a game table as played in a casino. The game may also be played with one or more players and can be embodied in an electronic device or board game as previously described and as described in more detail below. The number of players is determined by the number of cards in the deck needed to complete card game 10. Preferably, a standard deck of cards 16 is utilized for typically up to seven players. No cards are wild, nor are jokers present in the deck.

The concept of the game is to obtain the lowest score. Each player plays against the dealer playing for the house or against a hypothetical score. When the house is not dealt a hand as represented by the dealer, the dealer deals the cards to the other players. They try to obtain the lowest score in view of a hypothetical score for the house instead of an actual score made by the dealer representing the house. If the combination of each player's cards exceeds the hypothetical score, the house wins against each respective player.

Scoring of the cards is conventional but for the fact that the ace equals 1.Face cards all equal 10, and other cards represent their shown values.

A bonus pat hand is desired. A bonus pat hand is a low score of 7 or less for the total of the three cards played by each player. When played against the dealer or with a bonus pat hand bet version of the game, a score of seven is arbitrarily selected. However, it can be any number designated by the house or an odds maker. A bonus pat hand is also payable for the cards designated in Tables 1-3.However, if the score of the bonus pat hand is lower than 7 and has the designated cards, only one bonus bet is paid. Further, a bonus bet can be made with an ante bet for playing the poker game. The bonus bet pays when the player wins the hand with a score as shown in Tables 1 and 2.A winning hand may be dealt by the dealer initially and played with the bonus pat hand. A player making a bonus bet and ante bet may lose the low score poker hand but win if the player's hand has the designated cards in Tables 1 and 2.The player may also win ante and bonus bet hands if he has the low score and designated cards for two payouts: an even payment on the ante bet and larger payment on the bonus pat hand bet. Only one bonus payout can be made for each player's hand. Some examples of bonus pat hands are shown by card values in the following Table 1.

TABLE 1

| | |
|---|---|
| A-A-A = | 3 |
| A-A-2 = | 4 |
| A-A-3 = | 5 |
| A-2-2 = | 5 |
| A-2-3 = | 6 |
| A-A-4 = | 6 |
| 2-2-2 = | 6 |
| A-2-3 (suited) = | 6 |
| A-A-5 = | 7 |
| A-2-4 = | 7 |
| A-3-3 = | 7 |
| 2-2-3 = | 7 |

In addition, a bonus bet can have payouts for any of the combination of cards shown in Tables 2 and 3, all of which are bonus, mulligan, or press bets. Payouts for the designated combination of cards for mulligan or draw and press bets are also shown in Tables 2 and 3.All bonus payouts are based on the amount of the bonus bet. A mulligan or press bet, no matter the amount, will be paid based on the amount bet for the bonus pat hand bet.

TABLE 2

| | | Bonus Bet | Mulligan or Press Bet |
|---|---|---|---|
| Hole in One | A-A-A | 150 to 1 | 50 to 1 |
| Par 3 | A-2-3 suited | 100 to 1 | 30 to 1 |
| Eagle | A-A-2 | 50 to 1 | 20 to 1 |
| Birdie | 5 or 6 | 30 to 1 | 10 to 1 |
| Par | 7 or 8 | 10 to 1 | 3 to 1 |

The bonus bet generally has a payout. The bonus bet is made before cards are dealt and is effective for the first three cards dealt. No mulligan bets are made when a bonus pat hand bet is made. The ante bet is also made before cards are dealt, either with a bonus bet or without a bonus bet. The mulligan bet is made by the player after the cards are dealt with an ante bet made and before 1 to 2 new cards are drawn. By playing a draw or mulligan bet, no bonus bet can be paid on the combination of cards shown in Tables 1-3.Payouts for mulligan bets must be followed. Increased payouts are made off the bonus bet. Ante, mulligan and press bets pay even odds unless a bonus pat hand bet is made before cards are dealt. With the bonus bet made, the increased payouts of Table 2 are made for mulligan and press bets.

The press bet is made if no mulligan bet is made nor cards drawn in both instances where the previous bets were bonus and ante bets or just the ante bet. The payouts or odds are proportional to the most difficult golf score as shown in Table 2.For example, a hole-in-one has the highest odds, while a par golf score has the lowest. The odds or payouts in Tables 2 and 3 are arbitrary, but whatever value is given, the highest odds and payouts are assigned to the hole-in-one hand, A-A-A, which has a score of 3 and is intended to be analogous with the most difficult golf score.

TABLE 3

| | | Bonus Bet | Mulligan or Press Bet |
|---|---|---|---|
| Bogie | 9 or 10 | 5 to 1 | 2 to 1 |
| Double Bogie | 11 or 12 | even | even |

Following the golf game vernacular, when the game is played without a hand for the house, a hypothetical score is utilized, namely, a bogie or double bogie score. This is a hypothetical score that the player must beat with a lower score. Sample hypothetical scores are shown in Table 3.Payouts are also shown on the table in FIGS. 6 and 7.

There are a few basic options for playing the game, which are described below with more particular reference to the drawings. Option 1 is where a player places only a bonus pat hand bet before cards are dealt. The bonus bet is placed if the player anticipates receiving a bonus pat hand score of 7 or less and/or the designated cards as shown in Tables 1-3.Once a bonus bet is placed, the hand cannot be withdrawn. A player may place only the bonus bet and therefore does not participate in the remainder of the game. The pat hand is placed in a reserved area identified as sand trap 20 on the table 12. If the player's hand scores with the designated cards shown in Tables 1-3, the player wins. Payout or odds for the bonus bet are typically higher than payouts for other types of bet in the present invention.

Referring to FIGS. 1 and 6-7 according to the first embodiment or option 100 for playing card game 10, steps of the methods are now described. FIG. 7 shows an exploded sectional view 5 of table 12 from FIG. 6.

Deck of cards 18 may be prepared in a conventional manner as step 102. As previously recited, one or more decks of cards may be utilized depending upon the number of players participating in the game. Before any cards are dealt, players place a bonus bet at step 104 hoping for a bonus pat hand. On table 12, the bonus is placed at bonus bet golf ball design 24. A bonus pat hand is described above, a pat hand that is only dealt to a player. At this time, a dealer, who represents the house in this embodiment, deals three cards face down to each player and to himself as step 106. Cards 16 are placed at card area 22 is shown on the table. Since this is a bonus pat hand, a game within the poker game, a player who chooses to make this election does not participate in the poker game but waits for the dealer to show hand as described at step 108. While the game may progress with other players, the bonus pat hand bet player does not participate. The player places his cards in sand trap 20 indicating he is not playing the hand because he did not make an ante bet. The dealer shows his hand at step 110. If the player has the bonus bet pat hand as designated in Tables 2 and 3, the player wins. If not, the dealer wins. If the player has a score lower than the dealer, he does not win unless he has one of the designated hands shown in Tables 2 and 3.

Figure 2:
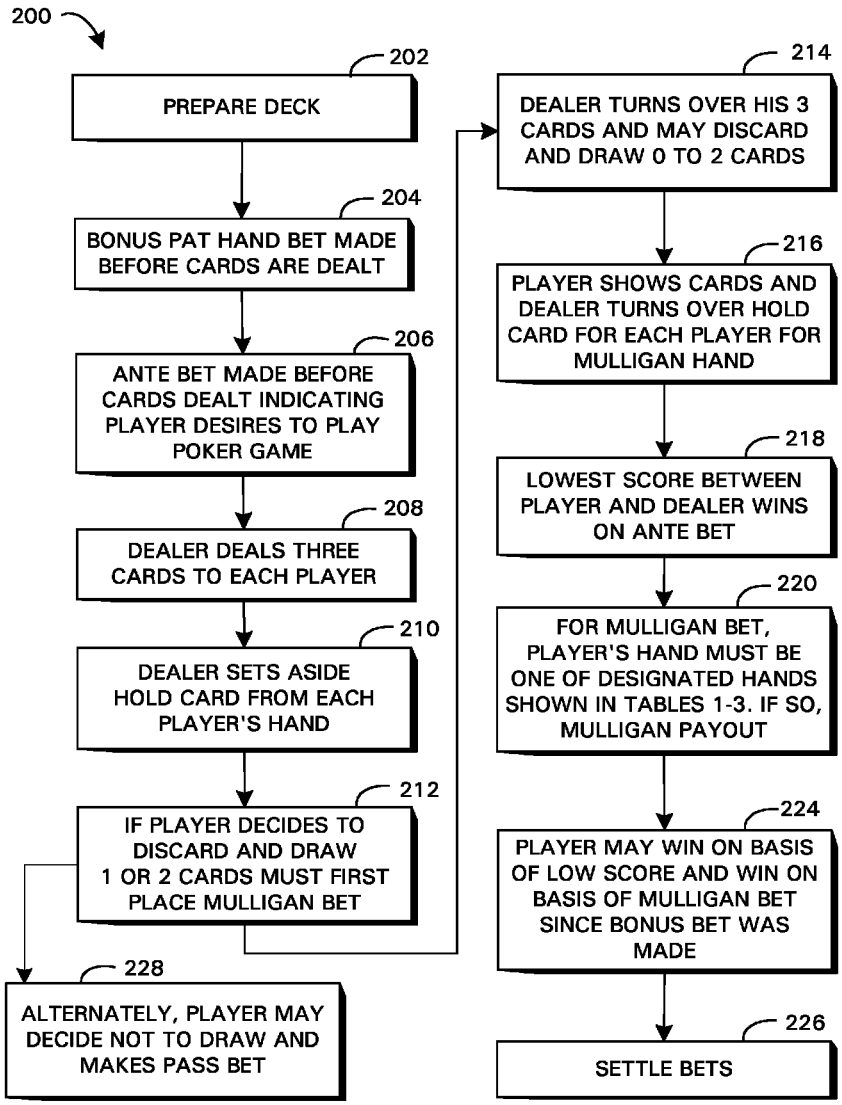
FIG. 2 shows a flow diagram of another embodiment of the method of playing a card game according to the present invention wherein bonus, ante and mulligan bets are made in the game.

Option 2 provides another method of playing the present invention and is described in FIGS. 2 and 6-7. A bonus bet pat hand is made, before the cards are dealt, as well as an ante bet. In this embodiment, the player is dealt additional cards face down and pays for them with a mulligan bet. The dealer may also discard and draw additional cards. The dealer's and players' cards are then compared, and the lowest hand wins. For the bonus pat hand bet, the hand must be one of the designated hands shown in Tables 2 and 3.If the player's hand is lower than the dealer's hand and with the designated cards, the dealer pays for the bonus bet and then pays the ante and the mulligan bet. If the designated cards are in the hand, the pat hand bonus is paid. If there is a lower poker hand then the dealer's and no designated cards, ante and mulligan bets are paid at an even payout. The bet payouts are even money for ante, press and mulligan bets. In this regard, the player may win or lose on the basis of a lowest score and win or lose on the basis of a bonus pat hand. This method is shown more precisely as follows in option 200 of FIG. 2. The deck is prepared at step 202, the bonus pat hand bet is made before the cards are dealt at step 204. In addition, an ante bet is made at this time before the cards are dealt because the player wishes to play a poker hand and not just the bonus bet pat hand. This is shown at step 206. The ante bet is placed at marker 26 on table 12 where the dealer deals three cards face down to each player as shown as step 208. The dealer sets aside one hold card 30 from each player's hand and places it in sand trap 20 on table 12. Hold card 30 is face down so it is not visible to the player. The player has an option of discarding and drawing one or two cards at this point in the game. However, the player must first place a mulligan bet at step 212. The ante bet is placed at area 26 on the table, and the mulligan bet is placed at drive design 28 on table 12. To indicate to a dealer the mulligan bet is being played, the hand with the drawn card(s) is placed on mulligan design 32 on the table. It is then the dealer's turn to review his cards by turning the three cards over. The dealer may discard and draw no cards or may choose to discard and draw up to two cards at step 214. The dealer's three-card hand is shown at 34 on the table. The mulligan bet provides the player with a second chance to have an increased payout. The payouts are shown in Tables 2-3 and table 36 on the playing table 12. At this point, there is no further betting and the player shows cards and the dealer turns over the hold card 30 for the mulligan hand at step 216. At step 218, the low score between the player and the dealer wins the ante bet which is placed at ante design 28. Regarding the bonus pat hand bet at 220, the player's hand must be one of the designated hands shown in Tables 1-3.If so, the bonus payout is made. Betting the bonus pat hand with the ante bet is particularly advantageous for the player because the player may win or lose on the basis of a low score and may win or lose on the basis of a bonus pat hand bet as shown at step 222. The player can only receive one bonus payout. He can win on the bonus bet for an increase and win on the poker hand by the ante and mulligan bets, which pay even money. He may win only on the designated hand for a bonus bet played or for the ante bet, which is an even payout 224. The bets are then settled at step 226. Step 228 of FIG. 2 is an alternate betting scheme if the player does not discard and draw new cards in step 212. In this regard, the player may make a press bet before step 214 where the dealer turns over his three cards. The pass bet at step (also shown in FIG. 3) is placed on the table at drive marker 28, the same marker for placing the mulligan bet. Marker 32 on the table for the mulligan is where the player places his hand after the final bet in the game and where the player shows cards to the dealer in step 216.

Figure 3:
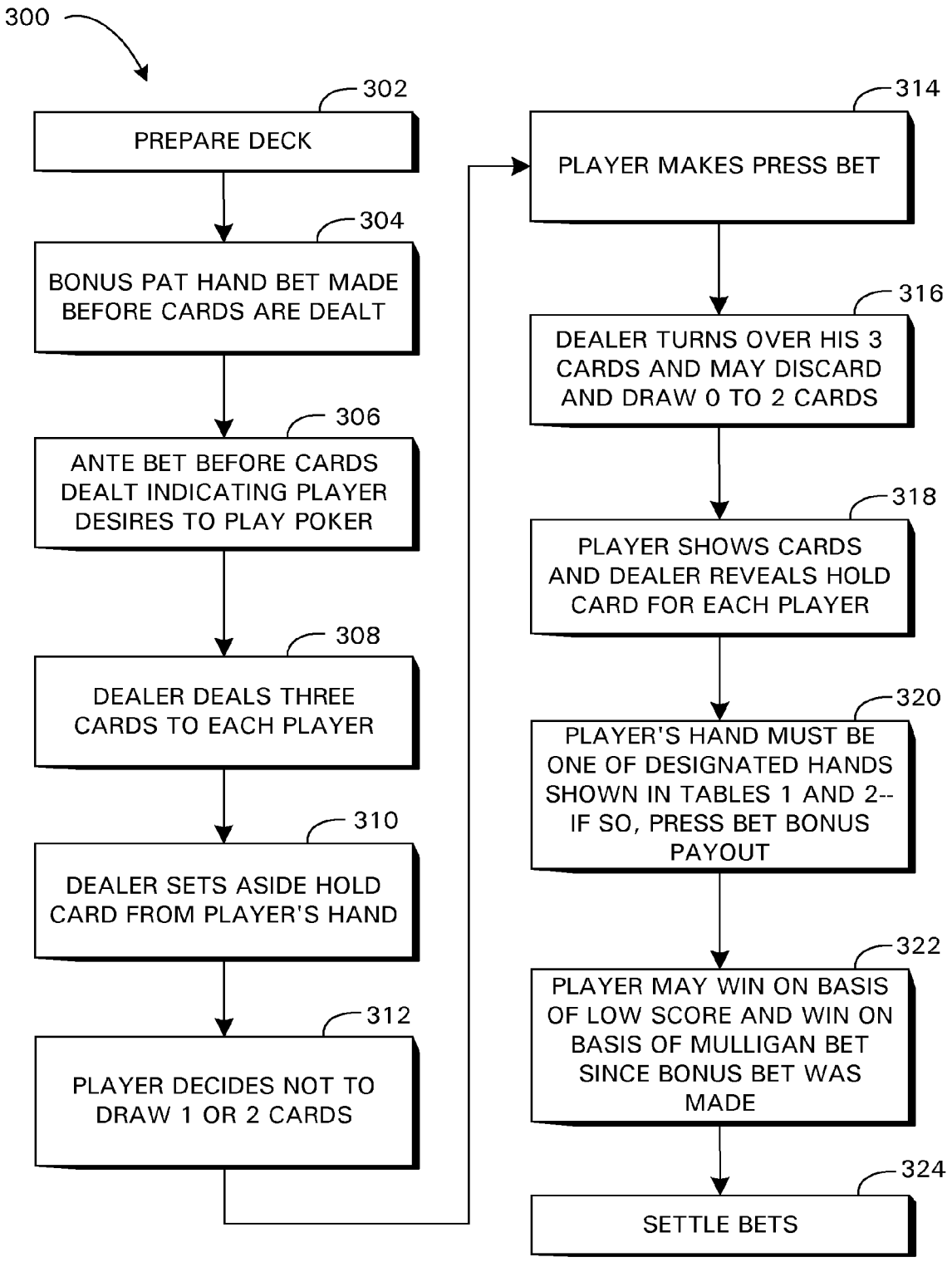
FIG. 3 shows a flow diagram of another embodiment of the method of playing a card game according to the present invention wherein bonus, ante and press bets are made in the game.

Another option of the game is shown in FIG. 3 as method 300. In this embodiment, no draw bet or mulligan bet is made. A bonus pat hand bet is made before the cards are dealt as well as an ante bet. The ante bet is made showing the intention of the player to play the poker hand. If no cards are discarded and drawn, the player simply makes a press bet. In detail, the deck is prepared at step 302, the bonus bet 304 and ante bet 306 are made before any cards are dealt. At step 308, the dealer deals three cards to each player and sets aside one card at 310. This hold card 30 is not shown to the player. At this point, 312, the player decides not to draw cards and places a press bet at 314. A press bet could have odds and increased payout. Next, the dealer turns over his three cards and may discard and draw zero to two cards in step 316. The player at 318 shows his cards, the dealer reveals the hold card for each player. The player's hand must be one of designated hands shown in Tables 2-3 in order for the bonus payout to occur, either the bonus pat hand or bonus press bet. Not more than one bonus can be paid to occur at step 320. The player may also win with the ante and press bets having the lowest score. These bets pay even odds at step 322. Thereafter, bets are settled by the dealer at step 324. By betting the press bet and the bonus pat hand bet, the player has two options of having increased payouts but only one payout can occur.

FIG. 4 describes another option where an ante bet is made as well as a draw or mulligan bet. In this arrangement, the player may win with even odds as a poker bet because no bonus bet was made, even if the designated cards of Table 1 and 2 appear. In this embodiment, no bonus pat hand bet is made. The deck is prepared at 402 and the ante bet is made at 404 before any cards are dealt by the dealer. The dealer then deals three cards to each player 406 and sets aside a hold card 30 at 408 from each of the player's hands. Hold card 30 is not shown to the player. At 410, the player decides to draw one or two cards if placing a mulligan bet. After the draw and mulligan bet, no other bets are made. The dealer then turns over his three cards at 412 and may discard and draw up to two cards. The player shows his cards and the dealer turns over the hold card for each player for the mulligan hand at 414. The lowest score between the player and the dealer wins on the ante bet at 416. The player's mulligan bet pays even odds. At 420, the player may win or lose. The payment is even. No bonus bets were made. At step 422, the bets are settled. Referring back to step 410, the player may decide not to draw and make a pass bet within the flow of diagrams shown in FIG. 4.

Another option of the game is shown in FIG. 5 as method 500. In this embodiment, no bonus bet is made. An ante bet is made showing the intention of the player to play the poker hand. If no cards are discarded and drawn, the player simply makes a press bet. In detail, the deck is prepared at step 502 and the ante bet is placed before any cards are dealt indicating the player desires to play the poker game at step 504. At step 506, the dealer deals three cards to each player and withholds a card from each player's hand at step 508. The player then decides not to draw any cards and therefore no mulligan bet is made at step 510. The player likes the cards dealt to him. At that time, the player may make a press bet at step 512 by placing the bet at marker 28 (DRIVE) on the table. The dealer then turns over his three cards and may discard and draw from zero to two cards at step 514. The player then discloses his cards and the dealer reveals the hold card for each player at step 516. The dealer reveals his cards and the lowest score between the dealer and player wins at step 518. The press and ante bets pay even and both will be paid with the low score.

Another embodiment of the game is not described in a flowchart but differs from the previous methods of the other embodiments in that it excludes a hand for the house. A dealer is present for distributing the cards. The house is not present in the game. Instead, a hypothetical score for the house may be utilized in every one of the previous embodiments. Hypothetical scores as shown in Table 3 may be used in place of the dealer's score of the previous embodiments. If the score of a player's hand is lower than the hypothetical score, the player wins. If the player's hand scores higher than the hypothetical score, the player loses in favor of the house. The payout numbers are generally higher than the games shown in the other embodiment. This embodiment provides for a quick, fast-acting game of low-score poker.

Whenever a player and dealer have the same score, it is a push and the bets remain, except for bonus bets, which are removed from table 12. However, if the designated cards are shown, the bonus bet will be paid even if the player and dealers have the same score.

Figure 8:
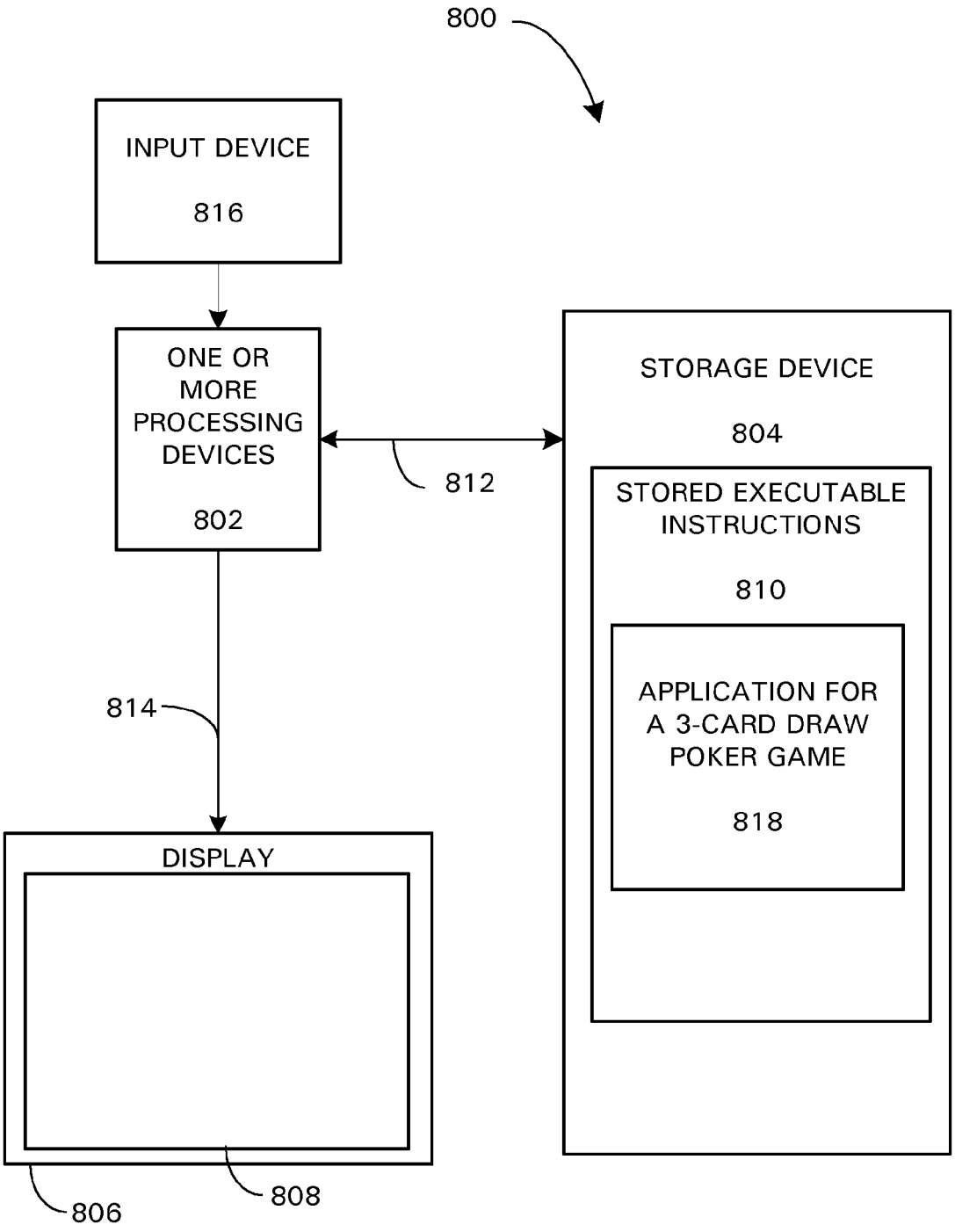
FIG. 8 shows a flow diagram of an embodiment of a method of playing a card game of the present invention using an electronic system.

In another embodiment shown in FIG. 8, an electronic system may contain logic to function as the dealer or house while displaying visual representations of the cards, for example, on a display. Although the electronic system may be contained within one device, the word "system" is used because the various elements described below may be distributed in any suitable form and operatively coupled by any suitable means. For example, the game may be distributed over the Internet such that many of the components of the system are remote to the player and the display described below is local for the user. The golf game motif is used in the display system, similar to table 12. However, any suitable game theme can be utilized.

As shown in FIG. 8, electronic system 800 includes one or more processing devices 802, at least one storage device 804, and display 806, which contains a graphical user interface ("GUI") 808. Examples of electronic system 800 include a personal computer, a laptop computer, a standalone electronic device, a network of distributed electronic devices or components, or any other suitable system.

One or more processing devices 802 may include one or more central processing units (CPUs), distributed processing circuitry, application specific integrate circuits (ASICs), state machines, discrete logic, or any other suitable processing circuitry known in the art. In system 800, the one or more processing devices 802, among other things, execute stored executable instructions 810 stored in storage device 804, such as an application for functioning as a dealer or house for the poker game described herein. The one or more processing devices 802 may retrieve the stored executable instructions 810 in storage device 804 as storage device data 812. The one or more processing devices 802 may also send or receive other data as storage device data 812 to or from storage device 804.

The one or more processing devices 802 may also be operatively connected to display 806 and send and receive display data 814 to and from display 806. The display data may include, among other things, data for representing a visual representation of the poker game described herein. For example, as one skilled in the art will appreciate, if the system "provides a card," the system provides data representing a card, which may be displayed as a visual representation of the card on a display 806. An input device 816 is operatively connected to the one or more processing devices 802. The input device may be, for example, a mouse, a keyboard, or any other suitable device that allows the one or more processing devices to receive user input. In another example, the display 806 may be a touch screen display that allows a user to enter user input by touching the screen.

The storage device 804 contains stored executable instructions 810, which are executable by the one or more processing devices 802. In particular, some of the stored executable instructions 810 may include an application for a three-card draw poker game 818. The storage device 804 may be, for example, any type of memory conventionally known in the art, such as random access memory (RAM), read-only memory (ROM), programmable memory (PROM), erasable PROMs (EPROM), electrically erasable PROM (EEPROM), flash memory, magnetic storage devices (e.g., hard disks, floppy disks, magnetic tape), optical disc drives, or any other suitable non-volatile memory now known or later developed. It is further recognized that storage device 804 and/or the one or more processing devices 802 may be distributed.

The GUI 808 on display 806 allows one or more processing devices 802 to present information and otherwise interact with a user. The GUI may have characteristics such as a background color or image, icons, virtual representations of a poker game, virtual representations of a betting unit (e.g., chip, dollar, coins, or other betting units commonly used for betting on a poker game in a casino), display information representing dollar amounts (e.g., a numerical display representing the value of the betting units), and any other suitable displayed data.

In this example, the one or more processing devices 802 obtains stored executable instructions 810 as stored device data 812 from storage device 804. The stored executable instructions 810, when executed by the one or more processing devices 802, cause the one or more processing devices 802 to perform the methods described herein. Although system 800 may be used for multiple players, in a preferred embodiment, the poker game disclosed herein is played with one player using system 800.

For example, the one or more processing devices 802, based on the stored executable instructions 810, may provide, to a display, three cards from a virtual deck of cards face down to a player and a virtual dealer. The one or more processing devices then removes one card from the three cards dealt to each player and places it as a hold card, leaving each player with two cards. It is understood that this removal could be part of the providing of the cards, i.e., while providing the three cards, the one or more processing devices could designate one of the cards as a hold card. This designation could be made, for example, by placing the hold card in a different position on the display. The one or more processing devices 802 then requires the player to select and remove zero, one, or two cards from the two remaining cards. The player may remove the cards (or choose not to remove them) by using input device 816 (or a touch screen, as described above). Next, the player is provided with additional cards, where the quantity of additional cards is the same quantity that the player chose to remove. After the one or more processing devices 802 display the dealer's cards (i.e., cause the visual representations of the dealer's cards on the display 806 to include their values), the one or more processing devices 802determines the score of the player's card hand versus the score of the dealer's card hand.

It is understood that the system 800 may perform the other methods and operations to play the poker game described herein. Among other advantages, providing an application for a three-card draw poker game 818 in a system 800 allows a player to play the three-card draw poker game without requiring another person, such as a dealer or another player, to be available. Furthermore, the application 818 may allow more games to be played because there is not a need to handle cards and betting units. For example, there is not a need to shuffle a deck, dealing can occur faster, cards do not need to be collected after each game, betting units can be automatically distributed and counted faster, etc. One skilled in the art will recognize other advantages.

In all the embodiments, the dealer has an advantage because he doesn't have a hold card, which is required for each player. The dealer can view his cards at once and has the option of discarding and drawing one or two cards in an effort to obtain the lowest score. The players may discard 0, 1, or 2 cards without knowing the value of the face-down hold card, which makes the total score uncertain.

What has been described herein is merely illustrative of the principals of the game. For example, the table version of the game described herein and implemented as of the best mode for playing the game is for illustration purposes only. Other arrangements and methods may be implemented by those skilled in the art without departing from the scope and spirit of the present invention, for example, an electronic version of the game as well as Internet version of the game may also be implemented.

What is claimed is:

1. A system for playing a card game comprising:

(a) one or more processing devices; and (b) at least one storage device thereon having stored executable instructions that, when executed by the one or more processing devices, cause the one or more processing devices to:

(i) provide three cards, face down, on a display, from a deck of cards to a player and a dealer;

(ii) designate one card from the three cards dealt to the player as a hold card, leaving the player with two cards;

(iii) display the player's cards to the player, (iv) requiring the player to select and remove 0, 1, or 2 cards from the two cards remaining in step (iv);

(v) provide the player the number of cards discarded in step (iii) from the deck;

(vi) display the dealer's cards;

(vii) display the player's hold cards; and (viii) determine the score of the player's card hand versus the score of the dealer's card hand wherein a low score wins between the player's hand and the score of the dealer's hand.

2. The system for playing a card game of claim 1, wherein the player's hand is played against the dealer.

3. The system for playing a card game of claim 1, wherein the player does not discard cards dealt from the dealer.

4. The system for playing a card game of claim 1, wherein a bonus bet is made by the player before receiving cards.

5. The system for playing a card game of claim 1, wherein the player inputs user input to indicate calling a pat hand and does not participate in the rest of the hand.

6. The system for playing a card game of claim 1, wherein the player makes an ante bet before receiving cards.

7. The system for playing a card game of claim 1, wherein a press bet is made.

8. The system for playing a card game of claim 1, wherein the player makes a mulligan bet before discarding cards in step (iii).

9. The system for playing a card game of claim 1, wherein the stored executable instructions further cause the one or more processing devices to include more players in the card game.

10. The system for playing a card game of claim 1 wherein a player plays against a hypothetical score for the house.

* * * * *